US007609231B2

(12) United States Patent
Kwon et al.

(10) Patent No.: US 7,609,231 B2
(45) **Date of Patent: *Oct. 27, 2009**

(54) PLASMA DISPLAY PANEL

(75) Inventors: Jae-Ik Kwon, Suwon-si (KR); Kyoung-Doo Kang, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 1026 days.

This patent is subject to a terminal disclaimer.

(21) Appl. No.: 10/929,626

(22) Filed: Aug. 31, 2004

(65) Prior Publication Data

US 2005/0052359 A1 Mar. 10, 2005

(30) Foreign Application Priority Data

Sep. 4, 2003 (KR) ..... 10-2003-0061838

(51) Int. Cl.
*G09G 3/28* (2006.01)

(52) U.S. Cl. ..... 345/60; 345/61; 345/63; 345/65; 345/67

(58) Field of Classification Search ..... 345/25, 345/60–69, 72, 77, 582–584; 313/292, 510, 313/567, 582–587, 610, 631; 315/169.1, 315/169.4

See application file for complete search history.

(56) References Cited

U.S. PATENT DOCUMENTS 5,541,618 A 7/1996 Shinoda
5,640,068 A 6/1997 Amemiya
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.

(Continued)

FOREIGN PATENT DOCUMENTS

CN 1344005 4/2002

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Prabodh M. Dharia
(74) *Attorney, Agent, or Firm*—Robert E. Bushnell, Esq.

(57) ABSTRACT

A plasma display panel that includes a first substrate and a second substrate, address electrodes formed on the second substrate, barrier ribs arranged in a space between the first substrate and the second substrate to define a number of discharge cells and non-discharge regions, phosphor layers formed within each of the discharge cells, and display electrodes formed on the first substrate, having a sustain electrode (X electrode) and a scan electrode (Y electrode) in a corresponding pair within each of the discharge cells. The discharge cells are arranged to alternate "A" and "B" sections, where the distances (pitches) between the centers of the adjacent discharge cells are respectively "a" and "b" in which "a" is less than "b".

37 Claims, 9 Drawing Sheets

U.S. PATENT DOCUMENTS

| | | | | |
|---|---|---|---|---|
| 5,952,782 | A | 9/1999 | Nanto | |
| 6,249,264 | B1 * | 6/2001 | Sano et al. | 313/582 |
| RE37,444 | E | 11/2001 | Kanazawa | |
| 6,498,593 | B1 * | 12/2002 | Fujimoto et al. | 345/60 |
| 6,504,519 | B1 * | 1/2003 | Ryu et al. | 345/60 |
| 6,577,061 | B2 * | 6/2003 | Sano et al. | 313/582 |
| 6,603,263 | B1 * | 8/2003 | Hashimoto et al. | 313/584 |
| 6,630,788 | B1 * | 10/2003 | Park | 313/582 |
| 6,630,916 | B1 | 10/2003 | Shinoda | |
| 6,646,377 | B2 * | 11/2003 | Hashimoto | 313/582 |
| 6,707,436 | B2 | 3/2004 | Setoguchi et al. | |
| 6,727,869 | B1 * | 4/2004 | Kosaka | 345/60 |
| 7,088,314 | B2 * | 8/2006 | Harada et al. | 345/60 |
| 7,136,033 | B2 * | 11/2006 | Kim et al. | 345/60 |
| 7,166,960 | B2 * | 1/2007 | Kim et al. | 313/582 |
| 7,208,875 | B2 * | 4/2007 | Kwon et al. | 313/582 |
| 7,208,876 | B2 * | 4/2007 | Kang et al. | 313/582 |
| 7,230,379 | B2 * | 6/2007 | Kwon et al. | 313/583 |
| 7,365,712 | B2 * | 4/2008 | Yi | 345/67 |
| 2002/0000779 | A1 * | 1/2002 | Anders | 315/111.21 |
| 2002/0135303 | A1 * | 9/2002 | Hashimoto | 313/582 |
| 2003/0034734 | A1 * | 2/2003 | Kim et al. | 313/582 |
| 2003/0080682 | A1 * | 5/2003 | Nagano | 313/582 |
| 2004/0234902 | A1 * | 11/2004 | Toyoda et al. | 430/321 |
| 2005/0001551 | A1 * | 1/2005 | Kim et al. | 313/584 |
| 2005/0052137 | A1 * | 3/2005 | Kwon et al. | 313/584 |
| 2005/0077824 | A1 * | 4/2005 | Kim et al. | 313/583 |
| 2006/0164335 | A1 * | 7/2006 | Woo et al. | 345/60 |
| 2007/0114933 | A1 * | 5/2007 | Kim et al. | 313/582 |
| 2008/0094319 | A1 * | 4/2008 | Woo et al. | 345/72 |

FOREIGN PATENT DOCUMENTS

| | | |
|---|---|---|
| JP | 02-148645 | 6/1990 |
| JP | 10-149771 | 6/1998 |
| JP | 2845183 | 10/1998 |
| JP | 2917279 | 4/1999 |
| JP | 2001-043804 | 2/2001 |
| JP | 2001-325888 | 11/2001 |
| JP | 2002-197981 | 7/2002 |
| JP | 2002-245943 | * 8/2002 |
| JP | 3435650 | 6/2003 |

* cited by examiner

PLASMA DISPLAY PANEL

CROSS REFERENCE TO RELATED APPLICATION

This application relates to a U.S. patent application which is concurrently submitted to the U.S. Patent & Trademark Office with this application, and which is based upon a Korean Priority Ser. No. 2003-61840 entitled PLASMA DISPLAY PANEL filed in the Korean Industrial Property Office on 4 Sep. 2003. The related application is incorporated herein by reference in its entirety.

CLAIM OF PRIORITY

This application makes reference to, incorporates the same herein, and claims all benefits accruing under 35 U.S.C. § 119 from an application for PLASMA DISPLAY PANEL earlier filed in the Korean Intellectual Property Office on 4 Sep. 2003 and there duly assigned Serial No. 2003-61838.

BACKGROUND OF THE INVENTION

1. Field of the Invention

The present invention relates to a plasma display panel (hereinafter, PDP), and more particularly, to a PDP with a barrier rib structure which is defined independently for each discharge cell by barrier ribs formed between two substrates.

2. Description of the Related Art

Generally, a plasma display panel is a display device in which ultraviolet rays generated by gas discharge excite phosphors to realize predetermined images, and it has been spotlighted as a candidate for wide screen display devices since it enables production of large screen sizes with high resolution.

A generally known PDP is formed with address electrodes along one direction (in the X-axis direction of the drawing) on a rear substrate, and a dielectric layer is formed on an entire surface of the rear substrate covering the address electrodes. On the dielectric layer, barrier ribs of a stripe pattern are formed between each of the address electrodes, and red R, green G, blue B phosphor layers are formed in valleys between each of the barrier ribs.

In addition, display electrodes having a pair of transparent electrodes and bus electrodes are formed along the direction crossing the address electrodes (in the Y-axis direction of the drawing) on a surface of a front substrate opposing the rear substrate. A transparent dielectric layer and a MgO protective layer are formed covering the display electrodes on an entire surface of the front substrate.

The region where the address electrodes on the rear substrate intersect the display electrodes on the front substrate is a portion where discharge cells are formed.

An address voltage Va is applied between the address electrodes and the display electrodes to cause address discharge, and a sustain voltage Vs is applied to a pair of the display electrodes to cause sustain discharge. Then, generated vacuum ultraviolet rays excite phosphors so that they emit visible light through the front substrate and thereby display PDP images.

However, the PDP having the display electrodes and the barrier ribs of the stripe type, may cause crosstalk between the discharge cells adjacent to the barrier ribs. In addition, it may cause a mis-discharge between the adjacent discharge cells since the discharge spaces are connected to one another along the direction where the barrier ribs are formed. In order to prevent these problems, the distance between the display electrodes corresponding to the adjacent subpixels has to be greater than a certain level, which causes a reduction in improvement of efficiency.

To solve the above problems, the PDPs having improved electrodes and barrier ribs have been suggested.

That is, the PDP has barrier ribs of the stripe type, but a transparent electrode of display electrode has a shape such that it is extended from bus electrode to face each other in a pair within each discharge cell. U.S. Pat. No. 5,640,068 issued to Amemiya for Surface Discharge Plasma Display discloses a PDP related thereto.

However, even the PDP with the above structure cannot solve the mis-discharge along the direction of the barrier ribs mentioned above. For the purpose of solving this problem and enhancing the emission efficiency, a PDP is suggested which has barrier ribs of the matrix type formed with vertical barrier ribs and horizontal barrier ribs being perpendicular to each other. Japanese Laid-Open Patent No. 1998-149771 issued to Yatsuda, et. al., for Plasma Display Panel and Manufacture Thereof discloses a PDP related thereto.

In the PDP having the stripe type barrier ribs or the matrix type barrier ribs, as most areas except at the barrier ribs are designed as discharge spaces, the display electrodes pass over the discharging space so that opaque bus electrodes thereof obstruct the transmission of some visible light generated by gas discharge, thereby reducing the brightness.

Furthermore, in order to prevent the mis-discharge along the vertical direction, the distance between display electrodes corresponding to the adjacent discharge cells has to be over a certain level, which becomes a limiting factor for manufacturing a high resolution PDP.

Moreover, although technology is suggested which has black pigment bands between the adjacent discharge cells along the vertical direction in order to improve the contrast, it may limit achievement of high resolution since a predetermined width between display electrodes is required.

SUMMARY OF THE INVENTION

According to one aspect of the present invention, there is provided a PDP in which the distance between adjacent cells is reduced, and the display electrodes corresponding thereto are placed adjacently to achieve high resolution.

In addition, there is provided a PDP in which the sustain electrodes of the adjacent display electrodes are placed adjacently or integrated by improvement of the array of the display electrodes to increase the proportion of a black portion, thereby improving the contrast.

It is another object of the present invention, in the PDP, the sustain electrodes X without worry of the mis-discharge between each other can be placed adjacently or integrated between the adjacent discharge cells, and simultaneously the distance between the corresponding discharge cells can be reduced so that the PDP reproducing the high resolution image can be manufactured.

It is another object of the present invention to provide a PDP with a proportion of black portion be increased by widening the width of the bus electrode Xn of the sustain electrode X in the direction of the address electrodes, and therefore, the contrast be greatly improved without any additional material cost or any additional process.

According to the present invention, the plasma display panel includes a first substrate and a second substrate opposing each other; address electrodes formed on the second substrate; barrier ribs arranged in the space between the first substrate and the second substrate to define a plurality of discharge cells and non discharge regions; phosphor layers formed within each of the discharge cells; and display electrodes formed on the first substrate, each having a sustain electrode (X electrode) and a scan electrode (Y electrode) in a corresponding pair within each of the discharge cells. The non discharge region is arranged within the region surrounded by the horizontal axis and the vertical axis passing through the center of each of the discharge cells, and the region is at least greater than the width of the upper portion of each of the barrier ribs, and the discharge cells are arranged to form an alternating pattern such that the distances (pitches) between the centers of the adjacent discharge cells in the direction of the address electrodes are different from one another.

Preferably, each non-discharge region is formed to have an independent cell structure defined by the barrier ribs.

It is preferable that each of the discharge cells is formed such that the widths of both end portions thereof placed in the direction of the address electrodes become narrower as they become further from the center of the discharge cells.

The discharge cells are arranged to alternate "A" and "B" sections, where the distances (pitches) between the centers of the adjacent discharge cells are respectively "a" and "b" (a<b) being different from each other, and a section having the distance (pitch) "a" between the centers is "A" section, and a section having the distance (pitch) "b" between the centers is "B" section.

The barrier rib forming the discharge cell includes a first barrier rib member parallel to the direction of the address electrodes, and a second barrier rib member being oblique to the direction of the address electrodes, and it may include at least one bridge member formed between a pair of the adjacent discharge cells within the section B to connect the second barrier rib members. The second barrier rib members are formed to intersect the direction of the address electrodes.

The display electrodes corresponding to a pair of the adjacent discharge cells within the section A are arranged in the order of Y electrode-X electrode-X electrode-Y electrode, and are placed in such a manner that the distance between the adjacent sustain electrodes (X electrodes) within the section A is shorter than the distance between the adjacent scan electrodes (Y electrodes) within the section B.

According to another embodiment of the present invention, the display electrodes have an array structure of scan electrode (Y electrode)-sustain electrode (X electrode)-scan electrode (Y electrode) for each pair of the adjacent discharge cells within the section A.

Preferably, the width of the sustain electrode (X electrode) in the direction of the address electrodes is wider than the width of the scan electrode (Y electrode) in the direction of the address electrodes, and the sustain electrode (X electrode) has extension electrodes on both sides thereof.

The heights of the first barrier rib member and the second barrier rib member may be different from each other.

The discharge sustain electrode has bus electrodes arranged outward from the edge of the discharge areas of the discharge cells along the direction intersecting the direction of the address electrodes to form a corresponding pair within each of the discharge cells, and extension electrodes extending from the bus electrodes into each of the discharge cells to form an opposing pair, and the bus electrodes pass over the top portion of the second barriers ribs.

The extension electrodes maybe formed with transparent electrodes, and a concave portion may be formed on opposing end portions of each of the extension electrodes. It is preferable that the edge of the concave portion and the surrounding portion thereof are connected with each other to form a smooth curved line.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 7:
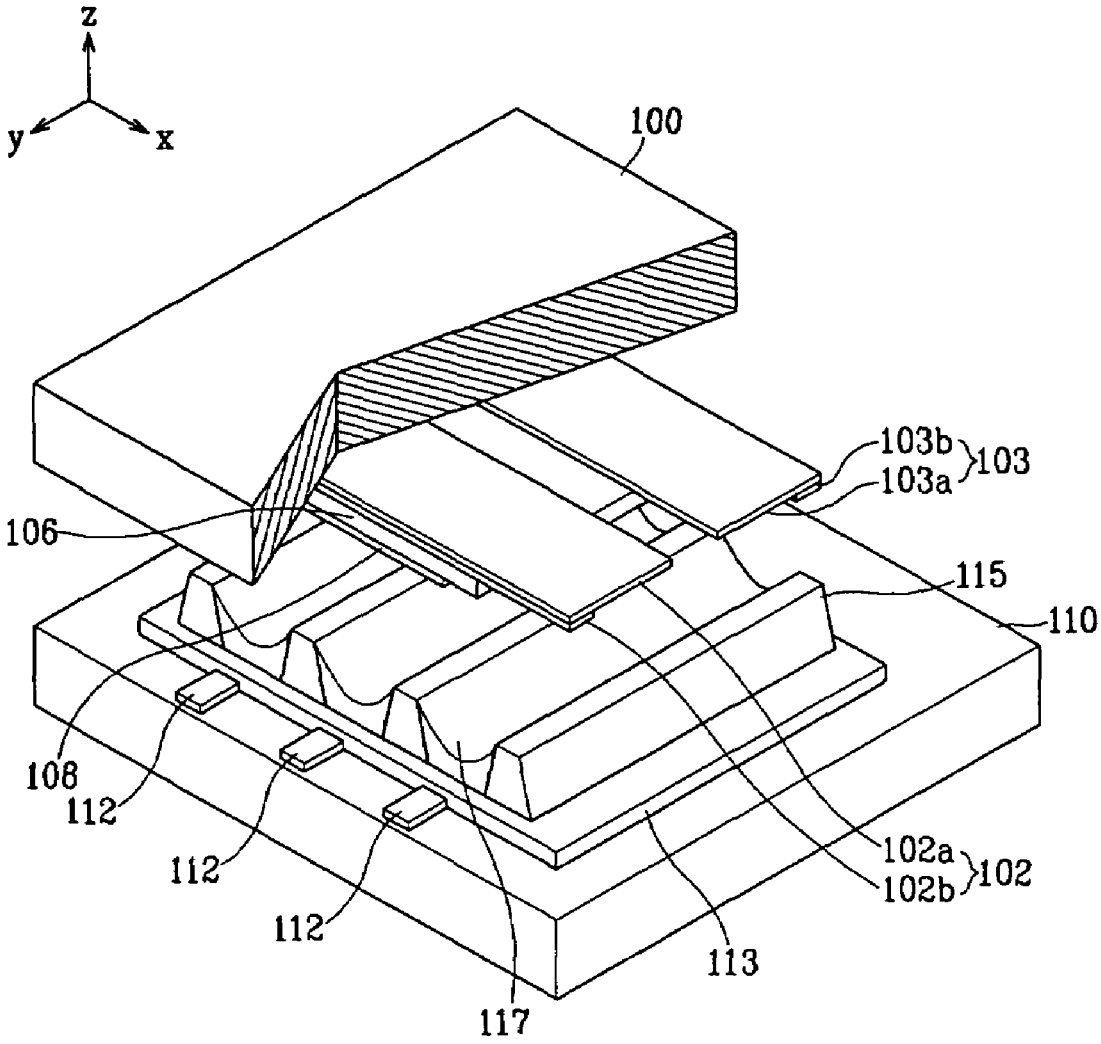
FIG. 7 is a partial exploded perspective view of a conventional PDP.

Turning now to the drawings, referring to FIG. 7, a generally known PDP is formed with address electrodes 112 along one direction (in the X-axis direction of the drawing) on a rear substrate 110, and a dielectric layer 113 is formed on an entire surface of the rear substrate 110 covering the address electrodes 112. On the dielectric layer 113, barrier ribs 115 of a stripe pattern are formed between each of the address electrodes 112, and red R, green G, blue B phosphor layers 117 are formed in valleys between each of the barrier ribs 115.

In addition, display electrodes 102, 103 having a pair of transparent electrodes 102*a*, 103*a* and bus electrodes 102*b*, 103*b* are formed along the direction crossing the address electrodes 112 (in the Y-axis direction of the drawing) on a surface of a front substrate 100 opposing the rear substrate 110. A transparent dielectric layer 106 and a MgO protective layer 108 are formed covering the display electrodes on an entire surface of the front substrate 100.

The region where the address electrodes 112 on the rear substrate 110 intersect the display electrodes 102, 103 on the front substrate 100 is a portion where discharge cells are formed.

An address voltage Va is applied between the address electrodes 112 and the display electrodes 102, 103 to cause address discharge, and a sustain voltage Vs is applied to a pair of the display electrodes 102, 103 to cause sustain discharge. Then, generated vacuum ultraviolet rays excite phosphors so that they emit visible light through the front substrate 100 and thereby display PDP images.

Figure 8:
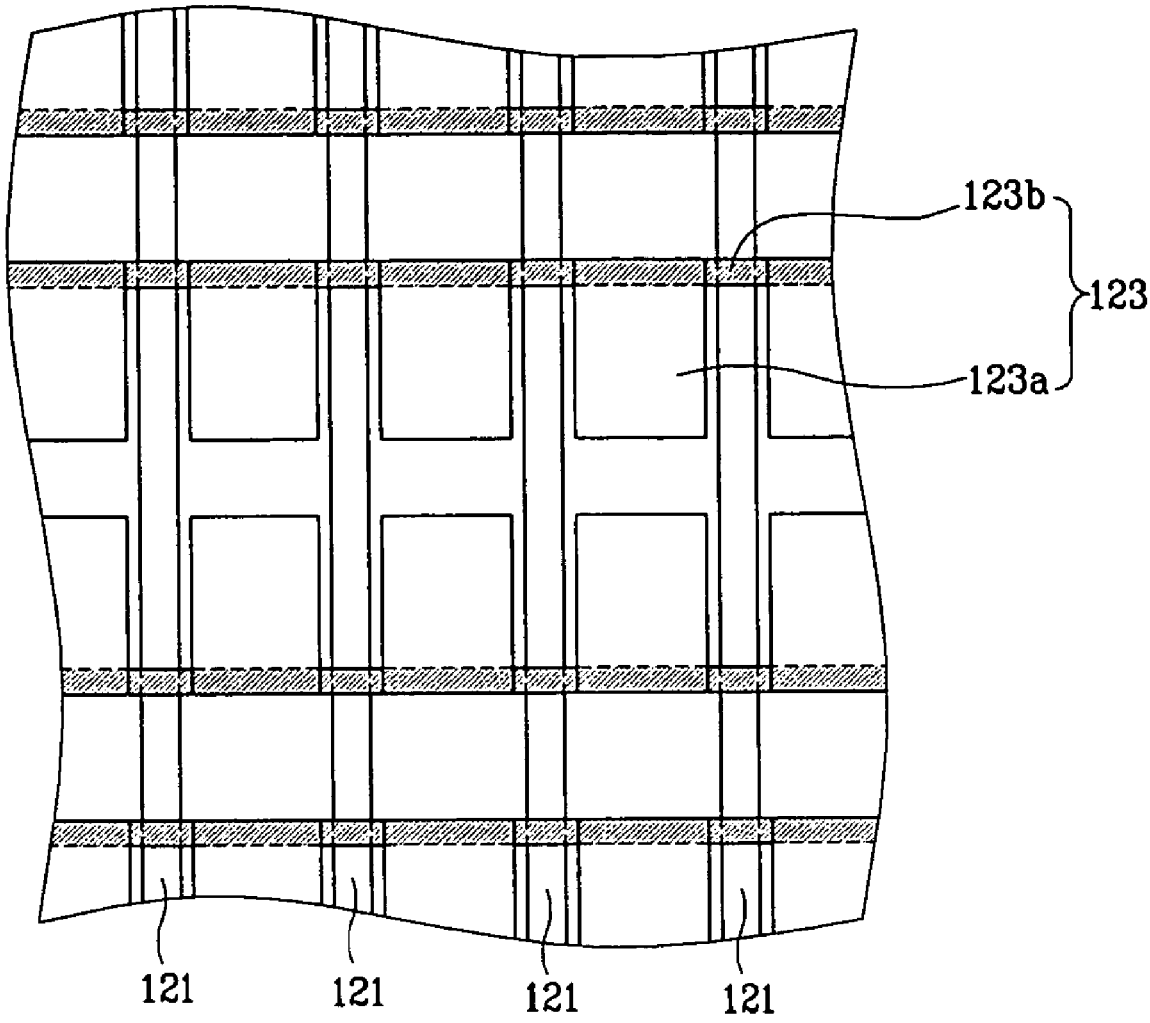
FIG. 8 is a plan view of a PDP having electrodes and a barrier rib structure according to a conventional art.

However, the PDP having the display electrodes 102, 103 and the barrier ribs 115 of the stripe type as shown in FIG. 8, may cause crosstalk between the discharge cells adjacent to the barrier ribs 115. In addition, it may cause a mis-discharge between the adjacent discharge cells since the discharge spaces are connected to one another along the direction where the barrier ribs 115 are formed. In order to prevent these problems, the distance between the display electrodes 102, 103 corresponding to the adjacent subpixels has to be greater than a certain level, which causes a reduction in improvement of efficiency.

Figure 9:
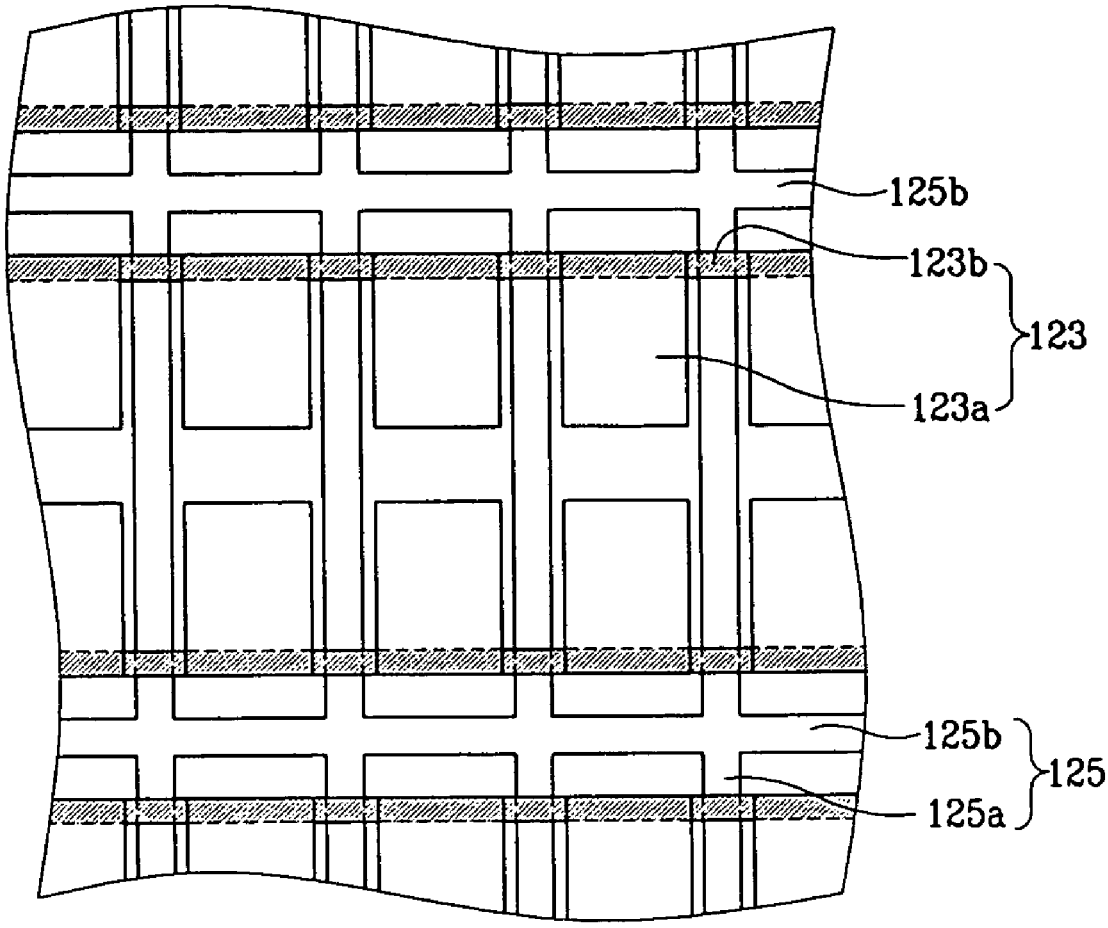
FIG. 9 is a plan view of a PDP having electrodes and a barrier rib structure according to a conventional art.

To solve the above problems, the PDPs having improved electrodes and barrier ribs as shown in FIGS. 8 and 9 have been suggested.

That is, the PDP shown in FIG. 8 has barrier ribs 121 of the stripe type, but a transparent electrode 123*a* of display electrode 123 has a shape such that it is extended from bus electrode 123*b* to face each other in a pair within each discharge cell. U.S. Pat. No. 5,640,068 discloses a PDP related thereto.

However, even the PDP with the above structure cannot solve the mis-discharge along the direction of the barrier ribs mentioned above. For the purpose of solving this problem and enhancing the emission efficiency, a PDP as shown in FIG. 9 is suggested which has barrier ribs 125 of the matrix type formed with vertical barrier ribs 125*a* and horizontal barrier ribs 125*b* being perpendicular to each other. Japanese Laid-Open Patent No. 1998-149771 discloses a PDP related thereto.

Exemplary embodiments of the present invention will now be described in detail with reference to the accompanying drawings.

Figure 1:
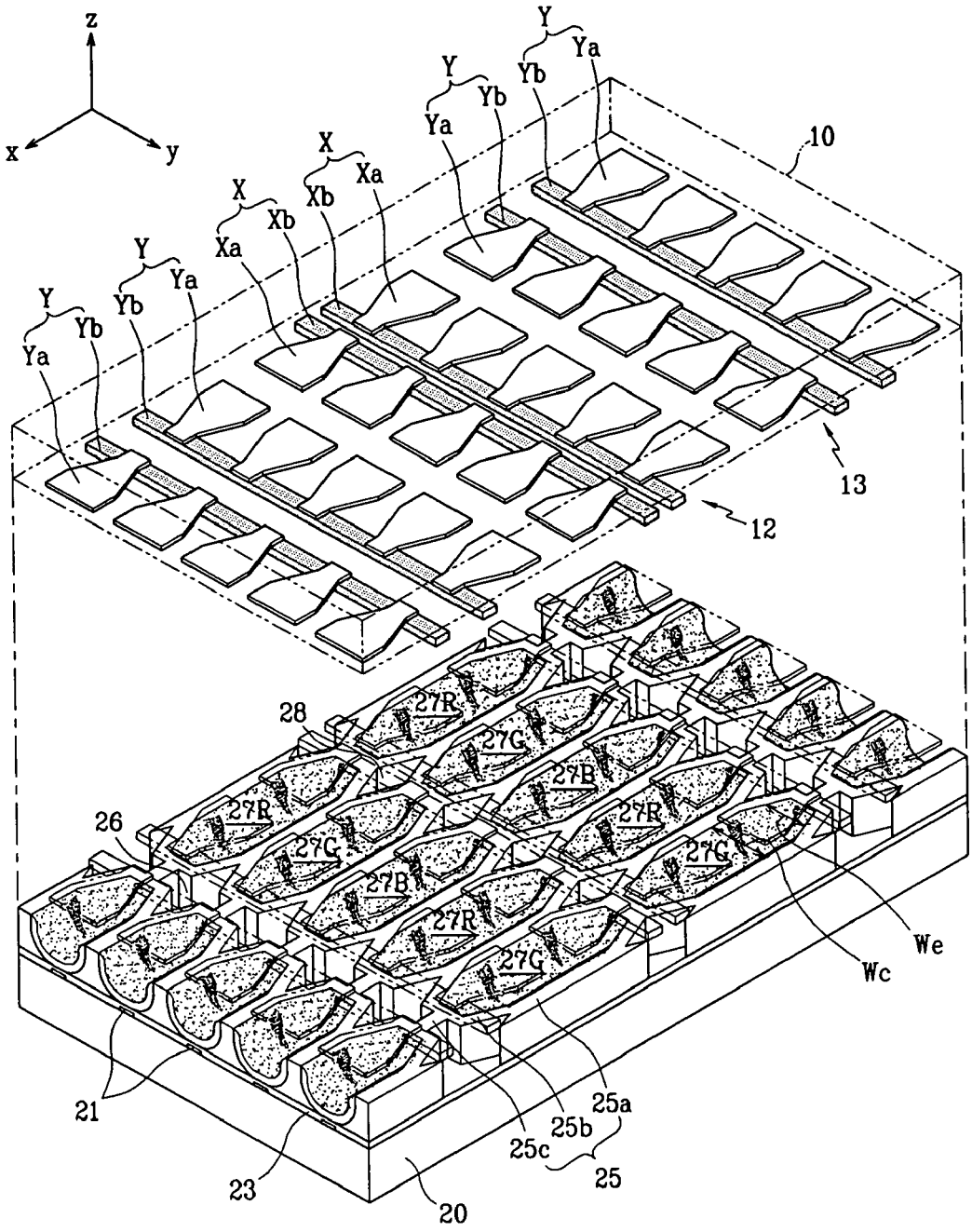
FIG. 1 is a schematic partial exploded perspective view of a PDP according to the first embodiment of the present invention.
Figure 2:
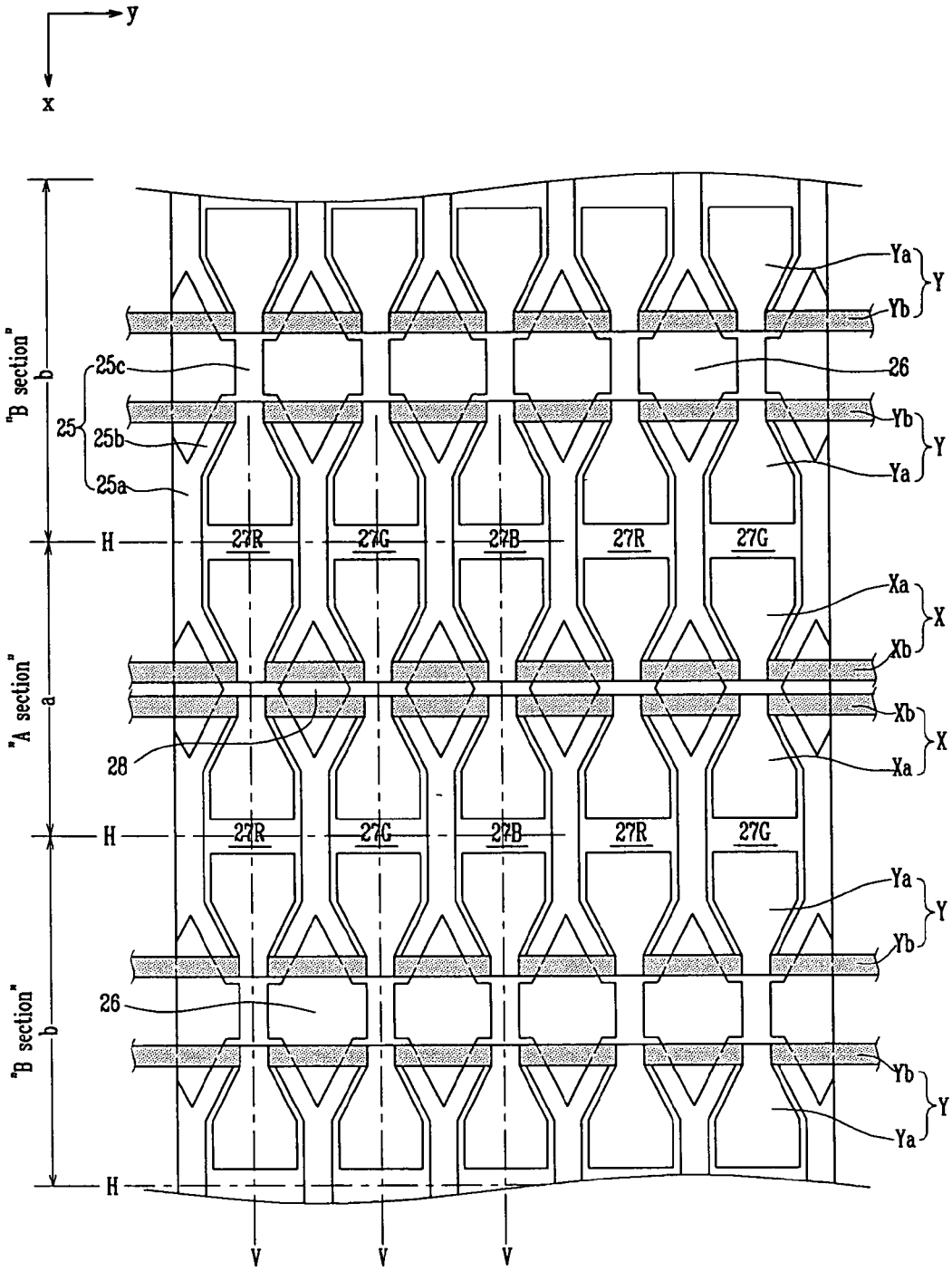
FIG. 2 is a plan view of the PDP according to the first embodiment of the present invention.

FIG. 1 is a schematic partial exploded perspective view of a PDP according to the first embodiment of the present invention, and FIG. 2 is a plan view of the PDP according to the first embodiment of the present invention.

As shown in the figures, the plasma display panel according to the first embodiment of the present invention is generally formed with a first substrate 10 and a second substrate 20 which are spaced at a predetermined distance while facing each other. In the space between both of the substrates 10 and 20, a plurality of discharge cells 27R, 27G, 27B in which plasma discharge takes place are defined by barrier ribs, and display electrodes 12 and 13 and address electrodes 21 are formed on the first substrate 10 and the second substrate 20, respectively.

In more detail, a plurality of the address electrodes 21 are formed along one direction (in the X-axis direction of the drawing) of the second substrate 20 on a surface of the second substrate 20 opposing the first substrate 10. The address electrodes 21 are formed in a stripe pattern and spaced apart from the adjacent address electrodes 21 at a predetermined distance while proceeding parallel to one another. A dielectric layer 23 is also formed on the second substrate 20 where the address electrodes 21 are established. The dielectric layer 23 is formed on an entire surface of the substrate covering the address electrodes 21. It should be noted that although the address electrodes of the stripe type are mentioned above, the type of the address electrodes is not limited to this pattern and may be formed in various ways.

Barrier ribs 25 are arranged in the space between the first substrate 10 and the second substrate 20 to define a plurality of discharge cells 27R, 27G, 27B and non-discharge regions 26 and 28. Preferably, the barrier ribs 25 are established on the top surface of the dielectric layer 23 formed on the second substrate 20. The discharge cells 27R, 27G, and 27B designate areas in which discharge gas is provided and where gas discharge is expected to take place with the application of an address voltage and a discharge sustain voltage. The non-discharge regions 26 and 28 are areas where a voltage is not applied such that gas discharge (i.e., illumination) is not expected to take place therein. It is preferable that the non-discharge regions 26 and 28 are formed to have a region which is at least greater than the width of the top portion of the barrier ribs 25.

The non-discharge regions 26 and 28 defined by the barrier ribs 25 are formed in areas encompassed by discharge cell abscissas H and ordinates V that pass through centers of each of the discharge cells 27R, 27G, and 27B, and that are respectively aligned with direction Y and direction X. In one embodiment, non-discharge regions 26 and 28 are centered between adjacent abscissas H and adjacent ordinates V. Stated differently, in one embodiment each pair of discharge cells 27R, 27G, and 27B adjacent to one another along direction X has a common non-discharge region 26 and 28 with another such pair of discharge cells 27R, 27G, and 27B adjacent along direction Y. The non-discharge regions 26 and 28 of the present invention are formed to have independent cell structures by the barrier ribs 25.

In the meantime, the discharge cells 27R, 27G, and 27B adjacent in the direction display electrode 12 and 13 are mounted (direction Y) are formed sharing at least one of the barrier ribs 25. Also, each of the discharge cells 27R, 27G, and 27B is formed such that the widths of both end portions thereof (in the direction of the display electrode, i.e. in the Y-axis direction of the drawing) placed in the direction of the address electrodes (in the X-axis direction of the drawing) become narrow as they become far away from the center of the discharge cells 27R, 27G, and 27B. That is, with reference to FIG. 1, a width Wc of a mid-point of the discharge cells 27R, 27G, and 27B is greater than a width We of the ends of discharge cells 27R, 27G, and 27B, and the width We of the ends becomes narrower further from the center of the discharge cells 27R, 27G, and 27B. Both end portions of the discharge cell 27R, 27G, and 27B in the direction of the address electrode 21 of the present embodiment form the shape of a trapezoid until reaching a predetermined location where barrier ribs 25 close off discharge cells 27R, 27G, and 27B, and accordingly, the overall planar shape of each of the discharge cells 27R, 27G, 27B is formed to be an octagon. However, as the present invention is not limited to this, the shape might have the shape of a wedge or arc if the widths of both end portions of the discharge cells become narrower further from the center thereof.

The discharge cells 27R, 27G, and 27B being adjacent in the direction of the address electrodes are arranged to form an alternating pattern such that the distances (pitches) between the centers of the discharge cells are different from one another. That is, with reference to FIG. 2, where these distances (pitches) between the centers of the discharge cells are respectively "a" and "b" (a<b) being different from each other, and a section having "a" of the distance (pitch) between the centers is "A" section and a section having "b" of the distance (pitch) between the centers is "B" section, the discharge cells 27R, 27G, and 27B are arranged to alternate "A" and "B" sections.

Each of the barrier ribs 25 forming the discharge cells 27R, 27G, and 27B includes a first barrier rib member 25*a* parallel to the direction of the address electrodes 21 and a second barrier rib member 25*b* intersecting the direction of the address electrodes, and a bridge member 25*c* is formed between a pair of the adjacent discharge cells within the section B to connect the second barrier rib members 25*b*. Such a bridge member 25*c* is not formed in the section A, and the second barrier rib members 25*b* of the adjacent discharge cells 27R, 27G, and 27B are stuck to each other so that the distance (pitch) between the centers of the adjacent discharge cells within the section A is shorter than that of the adjacent discharge cells within the section B.

The display electrodes X and Y formed on the first substrate 10 are formed with a sustain electrode X and a scan electrode Y in a corresponding pair within each of the discharge cells 27R, 27G, and 27B along the direction (in the Y-axis direction of the drawing) intersecting the address electrode 21, and each of the sustain electrodes (X electrodes) and scan electrodes (Y electrodes) is formed with bus electrodes Xb and Yb and extension electrodes Xa and Ya extending from the bus electrodes Xb and Yb into each of the discharge cells as pairs. With this structure, the bus electrodes Xb and Yb are arranged outward of the edge of the discharge areas of the discharge cells 27R, 27G, and 27B, and are preferably formed to pass over the top portion of the second barrier rib members 25*b*. As a result, the bus electrodes Xb and Yb do not pass over the discharge cells 27R, 27G, and 27B, hence improving the brightness decrease caused by the bus electrodes generally being formed with metal electrodes. In addition, it is preferable that the extension electrodes Xa and Ya are formed with transparent electrodes, but they are not limited thereto so that they can be formed with an opaque electrode.

Further, a concave portion maybe formed in the center of the opposite end portions of each of the extension electrodes Xa and Ya establishing the display electrodes X and Y. By forming such a concave portion in the center of the end portion, the gap between the extension electrodes Xa and Ya opposing each other within one discharge cell 27R, 27G, and 27B becomes different. That is, a long gap is formed at the position where the concave portions are opposite, and a short gap is formed at the position where convex portions in both sides of the concave portions are opposite, which causes plasma discharge generated from the center of the discharge cells 27R, 27G, and 27B to diffuse more efficiently, thereby enhancing the discharge efficiency.

The edges of the concave portion of the extension electrodes Xa and Ya may be connected with the surrounding portion to form a smooth curved line, thereby preventing the electric field concentration.

The display electrodes X and Y, as described above, are arranged in the order of scan electrode Y-sustain electrode X-sustain electrode X-scan electrode Y within a pair of the discharge cells adjacent to each other in the section A, and this array is repeated upward and downward. That is, it has an array structure of . . . -Y-X-X-Y-Y-X-X-Y-Y- . . . Then, the electrode array of-X-X-is arranged within the section A, and the electrode array of-Y-Y-within the section B, and accordingly, the distance between the adjacent sustain electrodes (X electrodes) within the section A is shorter than the distance between the adjacent scan electrodes (Y electrodes) within the section B.

As described above, by forming and arranging the discharge cells and the display electrodes, the sustain electrodes X can be placed as adjacently as possible without worry of mis-discharge therebetween, and simultaneously the distance between the corresponding discharge cells can be reduced so that a PDP reproducing a high resolution image can be manufactured.

Red R, green G, and blue B phosphors are coated respectively within the inside of the discharge cells 27R, 27G, and 27B to form phosphor layers.

Figure 3:
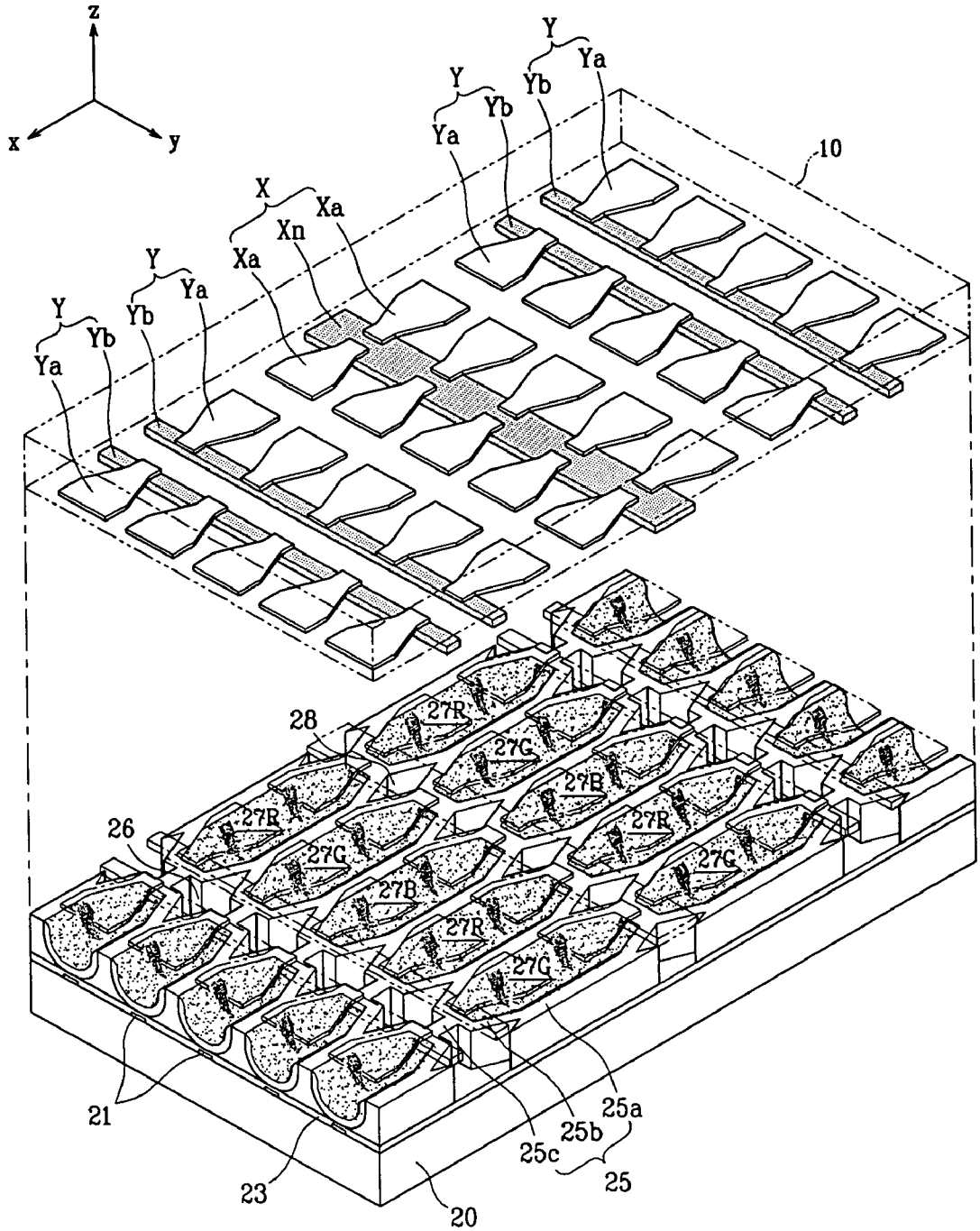
FIG. 3 is a schematic partial exploded perspective view of a PDP according to the second embodiment of the present invention.
Figure 4:
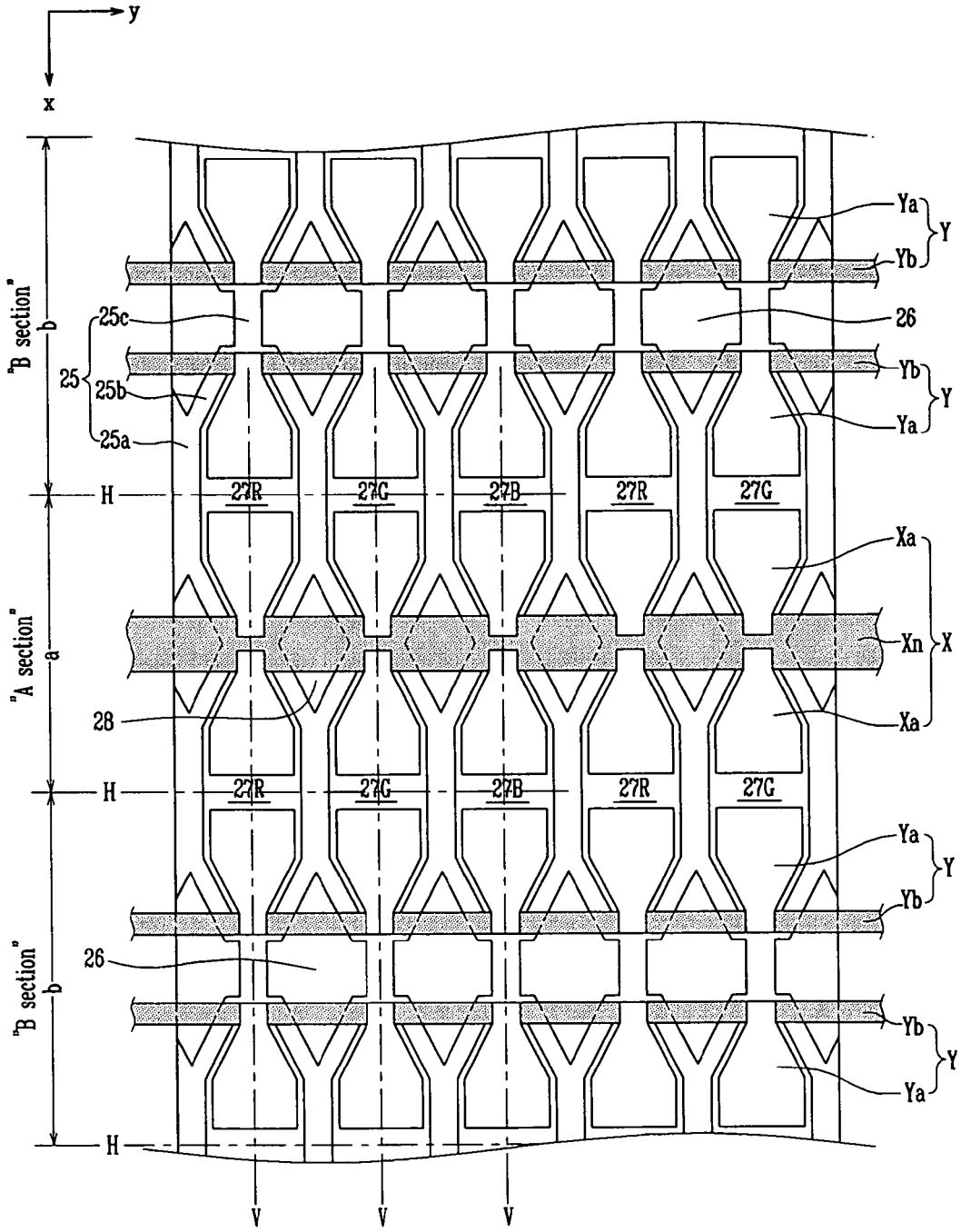
FIG. 4 is a plan view of the PDP according to the second embodiment of the present invention.

FIG. 3 is a schematic partial exploded perspective view of a PDP according to the second embodiment of the present invention, and FIG. 4 is a plan view of the PDP according to the second embodiment of the present invention. The PDP of the present embodiment has substantially the same discharge cell structure as the PDP according to the first embodiment mentioned above. In the following embodiments, the same elements are indicated by the same reference numerals.

With reference to FIGS. 3 and 4, the discharge cells 27R, 27G, and 27B being adjacent in the direction of the address electrodes are arranged to form an alternating pattern such that the distances (pitches) between the centers of the discharge cells are different from one another. Therefore, the discharge cells 27R, 27G, and 27B are arranged to alternate "A" and "B" sections, where these distances (pitches) between the centers of the discharge cells are respectively "a" and "b" (a<b) being different from each other, and a section having the distance (pitch) "a" between the centers is the "A" section and a section having the distance (pitch) "b" between the centers is the "B" section. The discharge cells 27R, 27G, and 27B are arranged to alternate "A" and "B" sections.

Each of the barrier ribs 25 forming the discharge cells 27R, 27G, and 27B includes a first barrier rib member 25*a* parallel to the direction of the address electrodes 21 and a second barrier rib member 25*b* intersecting the direction of the address electrodes, and a bridge member 25*c* is formed between a pair of the adjacent discharge cells within the section B to connect the second barrier rib members 25*b*. Such a bridge member 25*c* is not formed in the section A, and the second barrier rib members 25*b* of the adjacent discharge cells 27R, 27G, and 27B are stuck to each other so that the distance (pitch) between the centers of the adjacent discharge cells within the section A is shorter than that of the adjacent discharge cells within the section B.

The display electrodes X and Y including sustain electrodes X and scan electrodes Y are formed along the direction (in the Y-axis direction of the drawing) intersecting the address electrodes 21, and each pair of the adjacent discharge cells within the section A is arranged to have an array structure of scan electrode Y-sustain electrode X-scan electrode Y, and this array is repeated upward and downward. That is, the sustain electrodes X arranged with the section A have one bus electrode Xn corresponding commonly to a pair of the adjacent discharge cells within this section, and extension electrodes Xa extending to the inside of the discharge cells corresponding thereto. Accordingly, they have an array structure of . . . -Y-X(X)-Y-Y-X(X)-Y- . . . as a whole.

As described above, by forming and arranging the discharge cells and the display electrodes, the sustain electrodes X are formed to be integrated between the discharge cells while being adjacent with each other without concern of mis-discharge between each other, and simultaneously the distance between the corresponding discharge cells can be reduced, so that a PDP reproducing the high resolution image can be manufactured.

Further, it is preferable that the width of the bus electrode Xn of the sustain electrodes X in the direction of the address electrodes is wider than the width of the scan electrode Y in the direction of the address electrodes, thereby increasing the proportion of the black portion, and consequently significantly improving the contrast without any additional material cost or any additional process.

Figure 5:
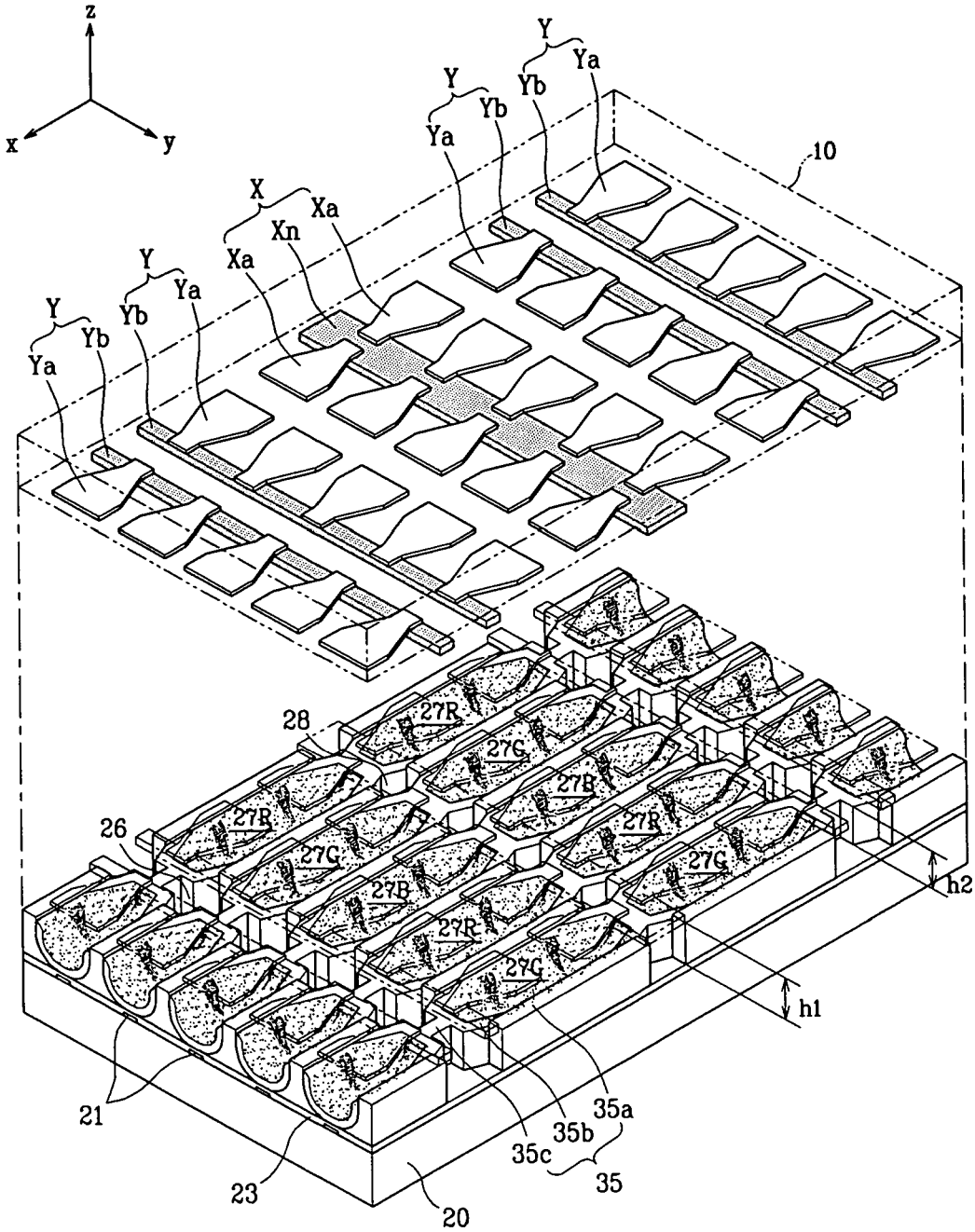
FIG. 5 is a schematic partial exploded perspective view of a modified example of the PDP according to the second embodiment of the present invention.
Figure 6:
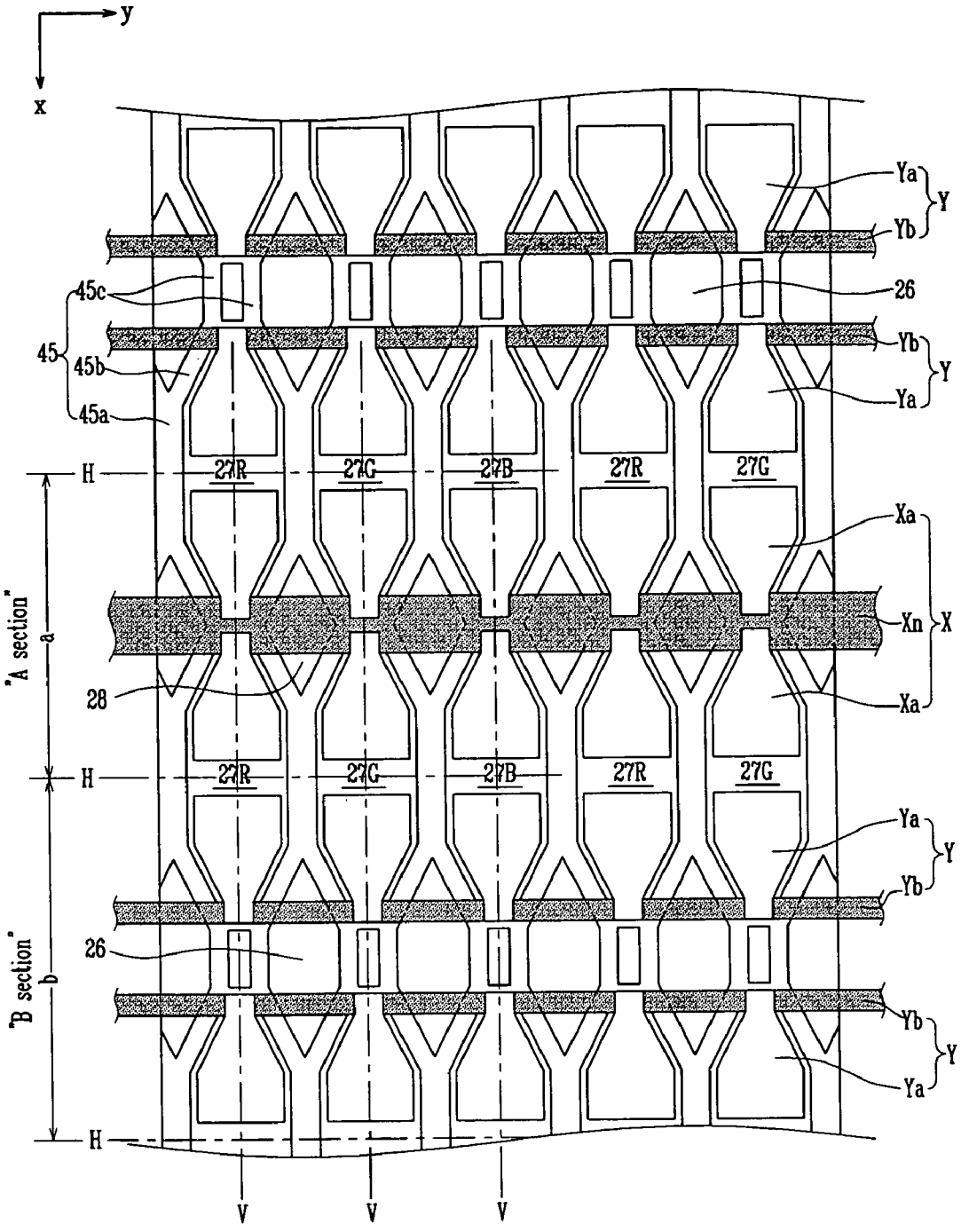
FIG. 6 is a plan view of another modified example of the PDP according to the second embodiment of the present invention.

FIGS. 5 and 6 are drawings schematically showing a PDP according to modified examples of the second embodiment of the present invention. Basically, the following modified examples have some modified characteristics while having the same array structure of discharge cells and display electrodes as the second embodiment of the present invention.

With reference to FIG. 5, the heights of the first barrier rib members 35*a* and the second barrier rib members 35*b* forming discharge cells 27R, 27G, and 27B may be different from each other so that in the modified example, the height of the first barrier rib members 35*a* is greater than that of the second barrier rib members 35*b*. With this structure, as an exhausted space is established between the first substrate 10 and the second substrate 20, the vacuum exhaustion can be achieved well when manufacturing a panel. Also, although as not shown in the figures, the height of the first barrier rib members may be smaller than the height of the second barrier rib members in the other modified example.

With reference to FIG. 6, in the embodiment, a pair of bridge members 45*c* is respectively formed between a pair of the discharge cells being adjacent in the direction of the address electrodes 21 within the section B.

As described above, in the PDP according to the present invention, the sustain electrodes X without worry of the misdischarge between each other can be placed adjacently or integrated between the adjacent discharge cells, and simultaneously the distance between the corresponding discharge cells can be reduced so that the PDP reproducing the high resolution image can be manufactured.

Moreover, the proportion of black portion can be increased by widening the width of the bus electrode Xn of the sustain electrode X in the direction of the address electrodes, and therefore, the contrast may be greatly improved without any additional material cost or any additional process.

Although the present invention has been described in detail hereinabove in connection with certain exemplary embodiments, it should be understood that the invention is not limited to the disclosed exemplary embodiments, but on the contrary is intended to cover various modifications and/or equivalent arrangements included within the spirit and scope of the present invention, as defined in the appended claims.

What is claimed is:

1. A plasma display panel comprising:

a first substrate and a second substrate opposing each other;

address electrodes formed on said second substrate;

barrier ribs arranged in the space between said first substrate and said second substrate to define a plurality of discharge cells and non-discharge regions;

phosphor layers formed within each of said discharge cells; and display electrodes formed on said first substrate, each having a sustain electrode (X electrode) and a scan electrode (Y electrode) in a corresponding pair within each of said discharge cells, wherein the non-discharge region is formed in an area encompassed by discharge cell abscissas that pass through centers of adjacent discharge cells and discharge cell ordinates that pass through centers of adjacent discharge cells, and the non-discharge region is at least greater than the width of the upper portion of each of said barrier ribs, wherein the discharge cells are arranged to form an alternating pattern such that the pitches between the centers of the adjacent discharge cells in the direction of the address electrodes are different from one another.

2. The plasma display panel of claim 1, wherein the non-discharge region is formed to have independent cell structures defined by said barrier ribs.

3. The plasma display panel of claim 1, wherein each of said discharge cells is formed to accommodate the widths of both end portions thereof placed in the direction of said address electrodes become narrower as they become further from the center of said discharge cells.

4. The plasma display panel of claim 1, wherein the discharge cells are arranged to alternate "A" and "B" sections, where the pitches between the centers of the adjacent discharge cells are respectively "a" and "b" (a<b) being different from each other, and a section having the pitch "a" between the centers is the "A" section, and a section having the pitch "b" between the centers is the "B" section.

5. The plasma display panel of claim 4, wherein a barrier rib forming a discharge cell includes a first barrier rib member parallel to the direction of the address electrodes, and a second barrier rib member being oblique to the direction of the address electrodes, and at least one bridge member is formed between a pair of the adjacent discharge cells within the section "B" to connect the second barrier rib members.

6. The plasma display panel of claim 5, wherein said second barrier rib members are formed to intersect the direction of said address electrodes.

7. The plasma display panel of claim 4, wherein the display electrodes corresponding to a pair of the adjacent discharge cells of which the boundary lies within the section A are arranged in the order of Y electrode-X electrode-X electrode-Y electrode, and are placed in such a manner that the distance between the adjacent sustain electrodes (X electrodes) within the section "A" is shorter than the distance between the adjacent scan electrodes (Y electrodes) in the section "B".

8. A plasma display panel comprising:

a first substrate and a second substrate opposing each other;

address electrodes formed on said second substrate;

barrier ribs arranged in a space between said first substrate and said second substrate to define a plurality of discharge cells and non discharge regions;

phosphor layers formed within each of the discharge cells; and display electrodes formed on said first substrate, wherein a non-discharge region is formed in an area encompassed by discharge cell abscissas that pass through centers of adjacent discharge cells and discharge cell ordinates that pass through centers of adjacent discharge cells, and the non-discharge region is at least greater than the width of the upper portion of each of said barrier ribs, wherein the discharge cells are arranged to form an alternating pattern such that the pitches between the centers of the adjacent discharge cells in the direction of said address electrodes are different from one another so that the discharge cells are arranged to alternate "A" and "B" sections, wherein the pitches between the centers of the adjacent discharge cells are respectively "a" and "b" (a<b) being different from each other, and a section having the distance (pitch) "a" between the centers is the "A" section, and a section having the pitch "b" between the centers is the "B" section, and wherein said display electrodes have an array structure of scan electrode (Y electrode)—sustain electrode (X electrode)—scan electrode (Y electrode) for a pair of the adjacent discharge cells of which the boundary lies within the section A.

9. The plasma display panel of claim 8, wherein the width of said sustain electrode (X electrode) in the direction of the address electrodes is wider than the width of said scan electrode (Y electrode) in the direction of said address electrodes.

10. The plasma display panel of claim 8, wherein said sustain electrode (X electrode) has extension electrodes on both sides thereof.

11. The plasma display panel of claim 8, wherein each non-discharge region is formed to have an independent cell structure respectively defined by said barrier ribs.

12. The plasma display panel of claim 8, wherein each of the discharge cells is formed such that the widths of both end portions thereof placed in the direction of the address electrodes become narrower as they become further from the center of said discharge cells.

13. The plasma display panel of claim 8, wherein said barrier rib forming the discharge cell includes a first barrier rib member parallel to the direction of said address electrodes, and a second barrier rib member being oblique to the direction of the address electrodes, and at least one bridge member formed between a pair of the adjacent discharge cells within the section "B" to connect said second barrier rib members.

14. The plasma display panel of claim 13, wherein said second barrier rib members are formed to intersect the direction of said address electrodes.

15. The plasma display panel of claim 13, wherein the heights of said first barrier rib member and the second barrier rib member are different from each other.

16. The plasma display panel of claim 13, wherein said display electrode has bus electrodes arranged outward of the edge of the discharge areas of said discharge cells along the direction intersecting the direction of said address electrodes to form a corresponding pair within each of the discharge cells, and extension electrodes extending from said bus electrodes into each of the discharge cells to form an opposing pair, wherein said bus electrodes pass over the top portion of said second barriers rib members.

17. The plasma display panel of claim 16, wherein said extension electrodes are formed with transparent electrodes.

18. The plasma display panel of claim 16, wherein a concave portion is formed on opposing end portions of each of said extension electrodes.

19. The plasma display panel of claim 18, wherein the edge of said concave portion and the surrounding portion thereof are connected with each other to form a smooth curved line.

20. A plasma display panel comprising:

a first substrate and a second substrate opposing each other;

address electrodes formed on said second substrate;

barrier ribs arranged in a space between said first substrate and the second substrate to define a plurality of discharge cells as independent cells;

phosphor layers formed within each of the discharge cells; and display electrodes formed on said first substrate, each having a sustain electrode (X electrode) and a scan electrode (Y electrode) in a corresponding pair within each of the discharge cells, wherein said discharge cells are arranged to form an alternating pattern such that the pitches between the centers of the adjacent discharge cells in the direction of the address electrodes are different from each other.

21. The plasma display panel of claim 20, wherein said discharge cells are arranged to alternate "A" and "B" sections, where the pitches between the centers of the adjacent discharge cells are respectively "a" and "b" (a<b) being different from each other, and a section having the pitch "a" between the centers is the "A" section, and a section having the pitch "b" between the centers is the "B" section.

22. A plasma display panel, comprising:

a plurality of barrier ribs arranged in the space between a first substrate and a second substrate to define a plurality of discharge cells and non-discharge regions, said second substrate including a plurality of address electrodes;

a plurality of display electrodes formed on said first substrate, each including a sustain electrode (X electrode) and a scan electrode (Y electrode) in a corresponding pair within each of said discharge cells, said discharge cells being arranged to form an alternating pattern such that the pitches between the centers of the adjacent discharge cells in the direction of the address electrodes are different from one another; and a non-discharge region formed in an area encompassed by discharge cell abscissas that pass through centers of adjacent discharge cells and discharge cell ordinates that pass through centers of adjacent discharge cells, and the non-discharge region being at least greater than the width of the upper portion of each of said barrier ribs.

23. The plasma display panel of claim 22, wherein the non-discharge region is formed to have independent cell structures defined by said barrier ribs.

24. The plasma display panel of claim 23, wherein each of said discharge cells is formed to accommodate the widths of both end portions thereof placed in the direction of said address electrodes becoming narrower as they become further from the center of said discharge cells.

25. The plasma display panel of claim 22, wherein the discharge cells are arranged to alternate first and second sections, where the pitches between the centers of the adjacent discharge cells are respectively a first pitch for the first section and second pitch for the second section, and the first and second pitches being different from each other, and a section having the first pitch between the centers is the first section, and a section having the second pitch between the centers is the second section.

26. The plasma display panel of claim 25, with said second pitch being greater than said first pitch.

27. The plasma display panel of claim 26, further comprised of one said plurality of barrier ribs forming a discharge cell includes a first barrier rib member parallel to the direction of said address electrodes, and a second barrier rib member being oblique to the direction of the address electrodes, and at least one bridge member being formed between a pair of the adjacent discharge cells within said second section to connect said second barrier rib members.

28. The plasma display panel of claim 27, wherein said second barrier rib members are formed to intersect the direction of said address electrodes.

29. The plasma display panel of claim 28, wherein said plurality of display electrodes corresponding to a pair of the adjacent discharge cells of which the boundary lies within said first section, are arranged in the order of Y electrode, X electrode, X electrode, Y electrode, and are placed in a manner that the distance between the adjacent sustain electrodes (X electrodes) within said first section is shorter than the distance between the adjacent scan electrodes (Y electrodes) in said second section.

30. The plasma display panel of claim 22, further comprised of the overall planar shape of each of the discharge cells being formed to be a member selected from a group consisting of an octagon, wedge, and arc, with the widths of both end portions of the discharge cells becoming narrower further from the center of the discharge cells.

31. The plasma display panel of claim 25, further comprised of each of said barrier ribs forming said discharge cells comprising a first barrier rib member parallel to the direction of said address electrodes, a second barrier rib member intersecting the direction of said address electrodes, and a bridge member being formed between a pair of the adjacent discharge cells within said second section to connect said second barrier rib members.

32. The plasma display panel of claim 31, further comprised of said bridge member not being formed in said first section, and said second barrier rib members of the adjacent discharge cells being coupled to each other to accommodate a pitch between the centers of the adjacent discharge cells within said first section being shorter than that of the adjacent discharge cells within said second section.

33. The plasma display of claim 32, further comprising of bus electrodes being arranged outward of the edge of the discharge areas of said discharge cells, and are formed to pass over the top portion of said second barrier rib members, accommodating said bus electrodes to not pass over said discharge cells.

34. The plasma display of claim 22, further comprised of said sustain electrodes arranged with said first section having one bus electrode corresponding commonly to a pair of the adjacent discharge cells within said first section, and extension electrodes extending to the inside of said discharge cells corresponding thereto.

35. The plasma display of claim 34, with width of said bus electrode of said sustain electrodes in the direction of the address electrodes being wider than the width of said scan electrode in the direction of said address electrodes.

36. The plasma display of claim 31, further comprised of the heights of said first barrier rib members and said second barrier rib members forming discharge cells being different from each other.

37. The plasma display of claim 22, further comprising a pair of bridge members being formed between a pair of said adjacent discharge cells within a second section to connect second barrier rib members, said discharge cells being arranged to alternate first and second sections, and said barrier ribs forming a discharge cell including a first barrier rib member parallel to the direction of said address electrodes, and said second barrier rib member being oblique to the direction of the address electrodes, and said pair of bridge member being formed between a pair of the adjacent discharge cells within said second section to connect said second barrier rib members.

* * * * *